US008314568B2

(12) United States Patent
Kobori

(10) Patent No.: US 8,314,568 B2
(45) Date of Patent: Nov. 20, 2012

(54) FLUORESCENT LAMP DRIVING METHOD AND APPARATUS

(75) Inventor: Kasumi Kobori, Miyagi (JP)

(73) Assignee: Sony Corporation, Tokyo (JP)

( * ) Notice: Subject to any disclaimer, the term of this patent is extended or adjusted under 35 U.S.C. 154(b) by 1199 days.

(21) Appl. No.: 12/051,320

(22) Filed: Mar. 19, 2008

(65) Prior Publication Data

US 2008/0238862 A1 Oct. 2, 2008

(30) Foreign Application Priority Data

Mar. 30, 2007 (JP) ..... 2007-090909

(51) Int. Cl.
*G05F 1/00* (2006.01)

(52) U.S. Cl. ..... 315/291; 315/307; 315/224; 315/246; 315/209 R; 315/118; 315/157

(58) Field of Classification Search ..... 315/209 R, 315/112, 118, 127, 149, 157, 224, 244, 254, 315/276, 227 R, 246, 307, DIG. 7; 345/87, 345/102, 204
See application file for complete search history.

(56) References Cited

U.S. PATENT DOCUMENTS 6,356,035 B1 * 3/2002 Weng ..... 315/209 R
7,161,305 B2 * 1/2007 Chen ..... 315/209 R
7,436,130 B2 * 10/2008 Komatsu et al. ..... 315/307
7,439,686 B2 * 10/2008 Usui ..... 315/277
7,453,216 B2 * 11/2008 Ushijima ..... 315/209 R
8,115,402 B2 * 2/2012 Kuang et al. ..... 315/209 R

FOREIGN PATENT DOCUMENTS

JP 2004-335362 11/2004
JP 2006-039558 2/2006
JP 2006-208510 8/2006
JP 2007-035497 2/2007

OTHER PUBLICATIONS

Japanese Office Action issued on Feb. 14, 2012, in connection with counterpart JP Application No. 2007-090909.

* cited by examiner

*Primary Examiner* — Haiss Philogene
(74) *Attorney, Agent, or Firm* — SNR Denton US LLP

(57) ABSTRACT

A fluorescent lamp driving method drives a fluorescent lamp by using an alternating current driving signal generated by an inverter circuit using direct current power as an input. The driving signal is supplied from the inverter circuit to a load including the fluorescent lamp. The method includes the steps of, by using a sum current detecting circuit, detecting a current change in the signal, by using a control circuit, controlling the driving signal generated by the inverter circuit on the basis of the current change detected by the sum current detecting circuit, and controlling a current of the supplied signal to be constant, by using a temperature detecting circuit, detecting the temperature of the fluorescent lamp, and, by using a correction circuit, on the basis of the temperature of the fluorescent lamp detected by the temperature detecting circuit, correcting the controlling the current of the supplied signal to be constant.

8 Claims, 6 Drawing Sheets

PRIOR ART

PRIOR ART FIG. 6
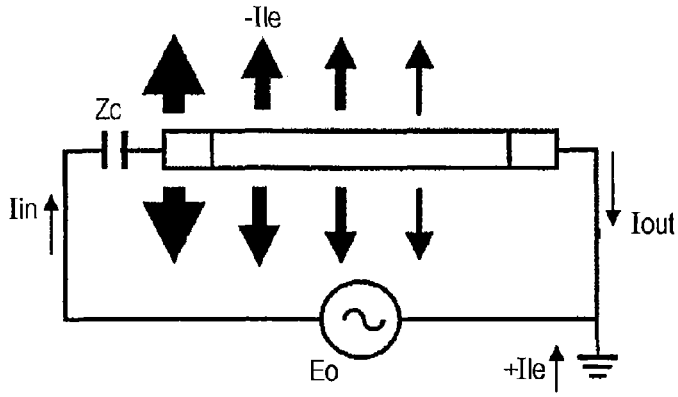
PRIOR ART FIG. 7
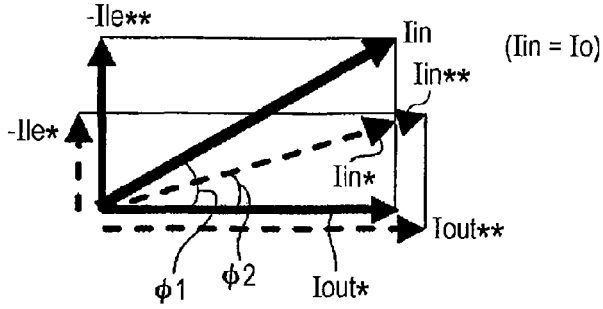

FLUORESCENT LAMP DRIVING METHOD AND APPARATUS

CROSS REFERENCES TO RELATED APPLICATIONS

The present invention contains subject matter related to Japanese Patent Application JP 2007-090909 filed in the Japanese Patent Office on Mar. 30, 2007, the entire contents of which are incorporated herein by reference.

BACKGROUND OF THE INVENTION

1. Field of the Invention

The present invention relates to a fluorescent lamp driving method and apparatus for driving, for example, a fluorescent lamp by stabilizing a current flowing in the fluorescent lamp for a change in input voltage.

2. Description of the Related Art

FIG. 4 is a circuit diagram showing a fluorescent lamp driving circuit of the related art which includes an inverter circuit 51 for driving cold cathode fluorescent lamps (CCFLs) 52.

In a backlight for a large liquid-crystal-display panel, the CCFLs 52 are used. In order for the CCFLs 52 to emit light, the inverter circuit 51 generates a high-voltage alternating current having several tens of kHz.

The CCFLs 52 have negative resistance characteristics. In order to drive the CCFLs 52 in parallel using a single inverter circuit (transformer), a function of balancing a current flowing in each CCFL is necessary.

Accordingly, in the fluorescent lamp driving circuit shown in FIG. 4, ballast capacitors Zc are used for the function of balancing the current flowing in each CCFL in the case of driving the CCFLs 52 in parallel.

A backlight unit provides a luminance necessary for an apparatus and needs to maintain the luminance stable. The inverter circuit 51 has a control function of maintaining a current sum Io of currents necessary for the CCFLs 52 to be constant.

The impedance of the CCFLs 52 is changed by a temperature or a current. Thus, by performing pulse-width-modulation (PWM) control (changing a ratio between a conduction time and a non-conduction time) that changes conduction times of switching elements Q1 and Q2 of the inverter circuit 51, or pulse-frequency-modulation (PFM) control that changes a driving frequency, an output voltage Eo of an inverter transformer T1 is changed, whereby the sum Io of the currents necessary for the CCFLs 52 is controlled to be constant.

FIG. 5 is a characteristic chart showing a relationship between the ambient temperature of the CCFLs 52 of the related art and the terminal voltage across ends of the CCFLs 52.

As shown in FIG. 5, the impedance of the CCFLs 52 is changed by an operating temperature. When the temperature of the CCFLs 52 increases, the impedance decreases. This change in impedance of the CCFLs 52 appears also as a change in phase angle of the impedance of the CCFLs 52. The sum Io of the currents necessary for the CCFLs 52 is the sum (represented by $I_1+I_2+I_3 \ldots$) of currents $I_1, I_2, I_3, \ldots$ in the CCFLs 52. In other words, the sum current Io is represented by the sum of current vectors $I_1, I_2, I_3, \ldots$ in accordance with the absolute values and phase angles of the CCFLs 52.

As a result, even if the magnitude of a current Iin supplied from the inverter circuit 51 is controlled to be constant by changing an output voltage Eo of the inverter transformer T1, a phenomenon occurs in which the current vectors $I_1, I_2, I_3, \ldots$ flowing in the CCFLs 52 vary with a changes in the impedance of the CCFLs 52.

FIG. 6 is a characteristic chart showing a state in which a high voltage applied to one CCFL 52 flows out as a leak current -Ile through a distributed capacity existing between a close conductor, such as a chassis and reflector included in the backlight unit, and the CCFL 52. The chart also shows the amount of the leak current -Ile.

As shown in FIG. 6, a high-voltage-applied side has a larger amount of the leak current -Ile. The leak current -Ile causes a capacitive load, so that the phase is ahead. If a load characteristic of the CCFL 52 is only a resistive component, a current Iout flowing only in the CCFL 52 is in phase with the voltage. The current Iin supplied from the inverter circuit 51 to the CCFL 52 is a resultant current Iout+Ile.

FIG. 7 is a vector diagram showing the current Iin supplied from the inverter circuit 51 to the CCFL 52.

As shown in FIG. 7, the current Iin supplied from the inverter circuit 51 to the CCFL 52 is a resultant current of the current Iout flowing only in the CCFL 52 and the leak current -Ile. The load of the CCFL 52 is not a pure resistance and the load has a large capacitive component. Thus, the phase of the resultant current Iin has to be ahead of the voltage, compared with the case of FIG. 7.

When the operating temperature of the CCFL 52 increases, the impedance decreases. If this change is resistive, a resistance value is small. Thus, the phase of the current Iin supplied from the inverter circuit 51 to the CCFL 52 lags behind.

The inverter circuit 51 controls the current Iin (the sum current Io) supplied from the inverter circuit 51 to the CCFL 52 to be constant, the current Iin being the sum current Iout+Ile. Thus, when the phase $\phi$ of the impedance of the CCFL 52 changes, as indicated by the dashed line in FIG. 7, the phase $\phi$ of the current Iin changes from $\phi$1 to $\phi$2. The current Iout flowing only in the CCFL 52 changes from Iout* to Iout. In addition, the leak current -Ile changes from -Ile to -Ile*.

As described above, even if the magnitude of the current Iin (the sum current Io) supplied from the inverter circuit 51 to the CCFL 52 is controlled to be constant, the impedance of the CCFL 52 changes due to ambient temperature and self-heating.

The amount of this change changes depending on the type and characteristics of a fluorescent lamp. In addition, a change $\Delta$Iout of the current Iout flowing only in the fluorescent lamp is greatly influenced by a phase difference between the voltage and current output from the inverter circuit 51.

As an inverter for driving a fluorescent lamp by stabilizing a current flowing in the fluorescent lamp, there is an inverter (see Japanese Unexamined Patent Application Publication No. 2004-335362) which stabilizes a current flowing in a fluorescent lamp by detecting and controlling the current, and in which, when ambient temperature of the inverter exceeds a set temperature, the current is decreased as the ambient temperature increases.

SUMMARY OF THE INVENTION

Accordingly, in a fluorescent lamp driving method and apparatus of the related art, a part of a current supplied from an inverter circuit to a CCFL flows out as a leak current through a distributed capacity existing between a close conductor, such as a chassis or reflector, and the CCFL, and the impedance of the CCFL changes with a change in temperature of the CCFL. Thus, even if the current Iin supplied from the inverter circuit to the CCFL is controlled to be constant, a problem occurs in that the current Iout flowing only in the CCFL changes.

The present invention has been made in view of the above circumstances. It is desirable to provide a fluorescent lamp driving method and apparatus that can stabilize a current flowing in a fluorescent lamp.

According to an embodiment of the present invention, there is provided a fluorescent lamp driving method for driving a fluorescent lamp by using an alternating current driving signal generated by an inverter circuit using direct current power as an input, the alternating current driving signal being supplied from the inverter circuit to a load including the fluorescent lamp. The fluorescent lamp driving method includes the steps of, by using a sum current detecting circuit, detecting a current change in the supplied alternating current driving signal, by using a control circuit, controlling the alternating current driving signal generated by the inverter circuit on the basis of the current change detected by the sum current detecting circuit, and controlling a current of the supplied alternating current driving signal to be constant, by using a temperature detecting circuit, detecting the temperature of the fluorescent lamp, and, by using a correction circuit, on the basis of the temperature of the fluorescent lamp detected by the temperature detecting circuit, correcting the control of the current of the supplied alternating current driving signal to be constant.

According to another embodiment of the present invention, there is provided a fluorescent lamp driving circuit for driving a fluorescent lamp by using an alternating current driving signal generated by an inverter circuit using direct current power as an input, the alternating current driving signal being supplied from the inverter to a load including the fluorescent lamp. The fluorescent lamp driving circuit includes a sum current detecting circuit configured to detect a current change in the supplied alternating current driving signal, a control circuit configured to control the alternating current driving signal generated by the inverter circuit on the basis of the current change detected by the sum current detecting circuit, and configured to control a current of the supplied alternating current driving signal to be constant, a temperature detecting circuit configured to detect the temperature of the fluorescent lamp, and a correction circuit configured to correct, on the basis of the temperature of the fluorescent lamp detected by the temperature detecting circuit, the control of the current of the supplied alternating current driving signal to be constant.

According to another embodiment of the present invention, there is provided a display apparatus including a liquid crystal display panel configured to display an image, and a backlight device configured to illuminate the liquid crystal display panel. The backlight device includes a fluorescent lamp driving circuit including a sum current detecting circuit configured to detect a current change in an alternating current driving signal generated by an inverter circuit using direct current power as an input, the alternating current driving signal being supplied to a load including a fluorescent lamp, a control circuit configured to control the alternating current driving signal generated by the inverter circuit on the basis of the current change detected by the sum current detecting circuit, and configured to control a current of the supplied alternating current driving signal to be constant, a temperature detecting circuit configured to detect the temperature of the fluorescent lamp, and a correction circuit configured to correct, on the basis of the temperature of the fluorescent lamp detected by the temperature detecting circuit, the control of the current of the supplied alternating current driving signal to be constant.

According to another embodiment of the present invention, there is provided a backlight device for illuminating a liquid crystal display panel for displaying an image. The backlight device includes a sum current detecting circuit configured to detect a current change in an alternating current driving signal generated by an inverter circuit using direct current power as an input, the alternating current driving signal being supplied to a load including a fluorescent lamp, a control circuit configured to control the alternating current driving signal generated by the inverter circuit on the basis of the current change detected by the sum current detecting circuit, and configured to control a current of the supplied alternating current driving signal to be constant, a temperature detecting circuit configured to detect the temperature of the fluorescent lamp, and a correction circuit configured to correct, on the basis of the temperature of the fluorescent lamp detected by the temperature detecting circuit, the control of the current of the supplied alternating current driving signal to be constant.

According to the embodiments of the present invention, an advantage is obtained in that a current flowing in a fluorescent lamp can be stabilized.

BRIEF DESCRIPTION OF THE DRAWINGS

FIG. 6 is a characteristic chart which shows a state in which a high voltage applied to one CCFL flows out as a leak current -Ile through a distributed capacity existing between a close conductor, such as a chassis and reflector included in a backlight unit, and the CCFL, and which shows the amount of the leak current; and FIG. 7 is a vector diagram showing a current Iin supplied from an inverter circuit to a CCFL.

DESCRIPTION OF THE PREFERRED EMBODIMENTS

First Embodiment

Next, a fluorescent lamp driving method according to a first embodiment of the present invention and an apparatus therefor are described with reference to the accompanying drawings.

Figure 1:
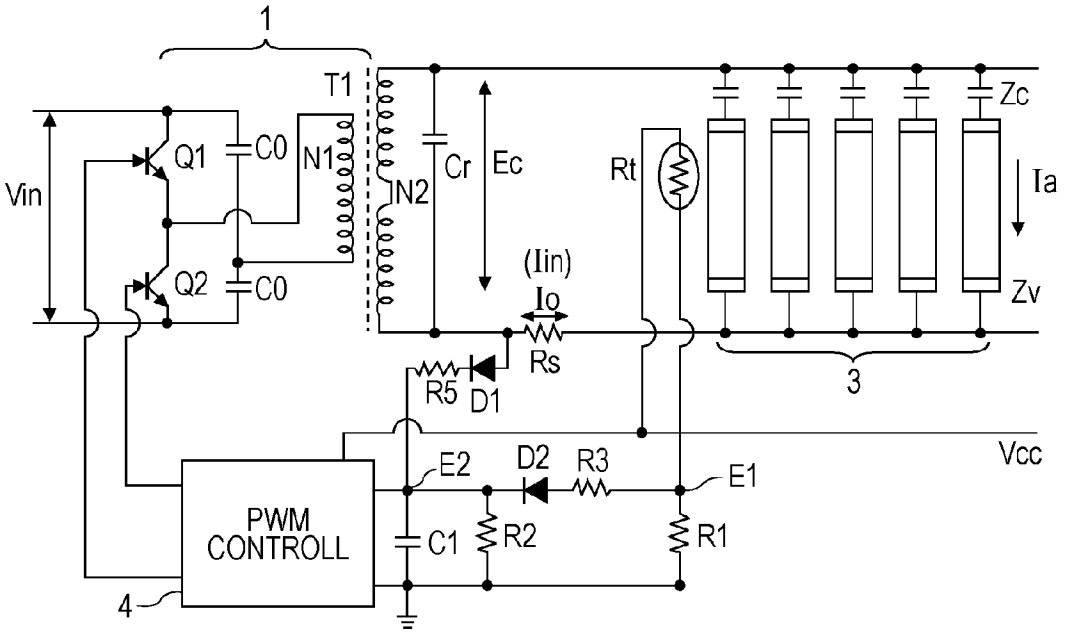
FIG. 1 is a circuit diagram showing the configuration of a fluorescent lamp driving circuit to which a fluorescent lamp driving method according to a first embodiment of the present invention is applied.

FIG. 1 is a circuit diagram showing the configuration of a fluorescent lamp driving circuit to which the fluorescent lamp driving method according to the first embodiment is applied.

The fluorescent lamp driving circuit includes a noise filter circuit (not shown) for suppressing a noise component included in alternating current power from a commercial power supply, a rectifying circuit (not shown) for converting the alternating current power into direct current power, and an inverter circuit 1. The inverter circuit 1 includes switching transistors Q1 and Q2 for alternately driving a primary winding N1 of an inverter transformer T1 on the basis of PWM control, and series capacitors CO connected in series to the primary winding N1 of the inverter transformer T1.

In the fluorescent lamp driving circuit, a parallel capacitor Cr is connected between output terminals of a secondary winding N2 of the inverter transformer T1. In addition, ballast capacitors Zc are connected in series to fluorescent lamps 3. The ballast capacitors Zc are used to balance currents Ia flowing in the fluorescent lamps 3.

In a path in which the currents Ia flow in common, a shunt resistor (sum current detecting circuit) Rs is inserted. The shunt resistor Rs is used to detect, as the amount of a voltage drop, a sum current Io supplied to the fluorescent lamps 3 which includes a leak current Ile caused by a distributed capacity existing between a close conductor, such as a chassis and reflector included in a backlight unit, and a current Iout flowing in the fluorescent lamps 3.

The sum current Io is the current Iin (described with reference to FIG. 7) represented by the resultant current Iout+Ile supplied from the inverter circuit 51 to the CCFL 52. As described above, the current Iin includes the leak current Ile caused by a distributed capacity existing between a close conductor, such as a chassis and reflector included in the backlight unit, and the fluorescent lamps 3, and the current Iout flowing in the fluorescent lamps 3.

In addition, the amount of a voltage drop generated across ends of the shunt resistor Rs in accordance with the sum current Io in the above loads can be supplied as a direct current voltage to a parallel circuit of a capacitor C1 and a resistor R2 which are connected to inputs of a PWM control unit 4 through a series circuit of a diode D1 and a resistor R5. One end of the parallel circuit of the capacitor C1 and the resistor R2 which are connected to the inputs of the PWM control unit 4 is connected so as to have a reference potential.

In the first embodiment, a temperature detecting element (temperature detecting) Rt for detecting the temperature of the fluorescent lamps 3 is used. The temperature detecting element Rt is connected in series to a resistor R1. One end of a series circuit of the temperature detecting element Rt and the resistor R1 is connected to a direct current power supply line Vcc, and the other end is connected so as to have the reference potential.

The resistance of the temperature detecting element Rt changes in accordance with the temperature of the fluorescent lamps 3. At a junction point between the temperature detecting element Rt and the resistor R1, a divided voltage E1 is generated which is obtained by dividing the power supply voltage of the power supply line Vcc at a voltage dividing ratio between the resistances of the temperature detecting element Rt and the resistor R1. The divided voltage E1 can be supplied to the parallel circuit of the capacitor C1 and the resistor R2 which are connected to the inputs of the PWM control unit 4.

The diode D1, the resistors R5 and R2, the capacitor C1, and the PWM control unit 4 form a control circuit in each of the appended claims 4, 7, and 8. Similarly, the resistors R1 and R3, and the diode D2 form a correction circuit in each of the appended claims 4, 7, and 8.

On the basis of the amount of the voltage drop generated in the shunt resistor Rs in accordance with the sum current Io supplied to the fluorescent lamps 3, the PWM control unit 4 generates a PWM-controlled transistor-driving signal. The PWM control unit 4 supplies the transistor-driving signal to bases of the switching transistors Q1 and Q2, whereby switching on and off of the switching transistors Q1 and Q2 and periods thereof are controlled.

In addition, at this time, for the amount of the voltage drop in accordance with the sum current Io input to the PWM control unit 4, by using the temperature detecting element Rt to detect the temperature of the fluorescent lamps 3, correction in accordance with the temperature of the fluorescent lamps 3 can be performed.

Next, an operation is described.

In this fluorescent lamp driving circuit, what is controlled to be constant is the sum current Io supplied to the fluorescent lamps 3 although this can apply to the fluorescent lamp driving circuit of the related art. The sum current Io is a high frequency current. As described above, the sum current Io is the current Iin represented by the resultant current Iout+Ile, and includes the leak current Ile and the current Iout flowing only in the fluorescent lamps 3.

It is necessary to control the current Iout flowing in the fluorescent lamps 3 to be constant. However, it is difficult to control the current Iout flowing only in the fluorescent lamps 3 to be constant since the sum current Io is a high frequency current. Accordingly, the sum current Io as the current Iin represented by the resultant current Iout+Ile is controlled to be constant.

In this case, even if the sum current Io is controlled to be constant, the impedance of the fluorescent lamps 3, particularly, a phase angle changes in accordance with the temperature of the fluorescent lamps 3. Thus, even in a case in which only the magnitude of the sum current Io as the current Iin is controlled to be constant, if also a phase change is not controlled to be constant, as shown in the vector diagram shown in FIG. 7, the current Iin changes to Iin, and the current Iout flowing only in the fluorescent lamps 3** also changes from Iout* to Iout, so that it is difficult to control the luminance of the fluorescent lamps 3** to be constant.

Figure 2:
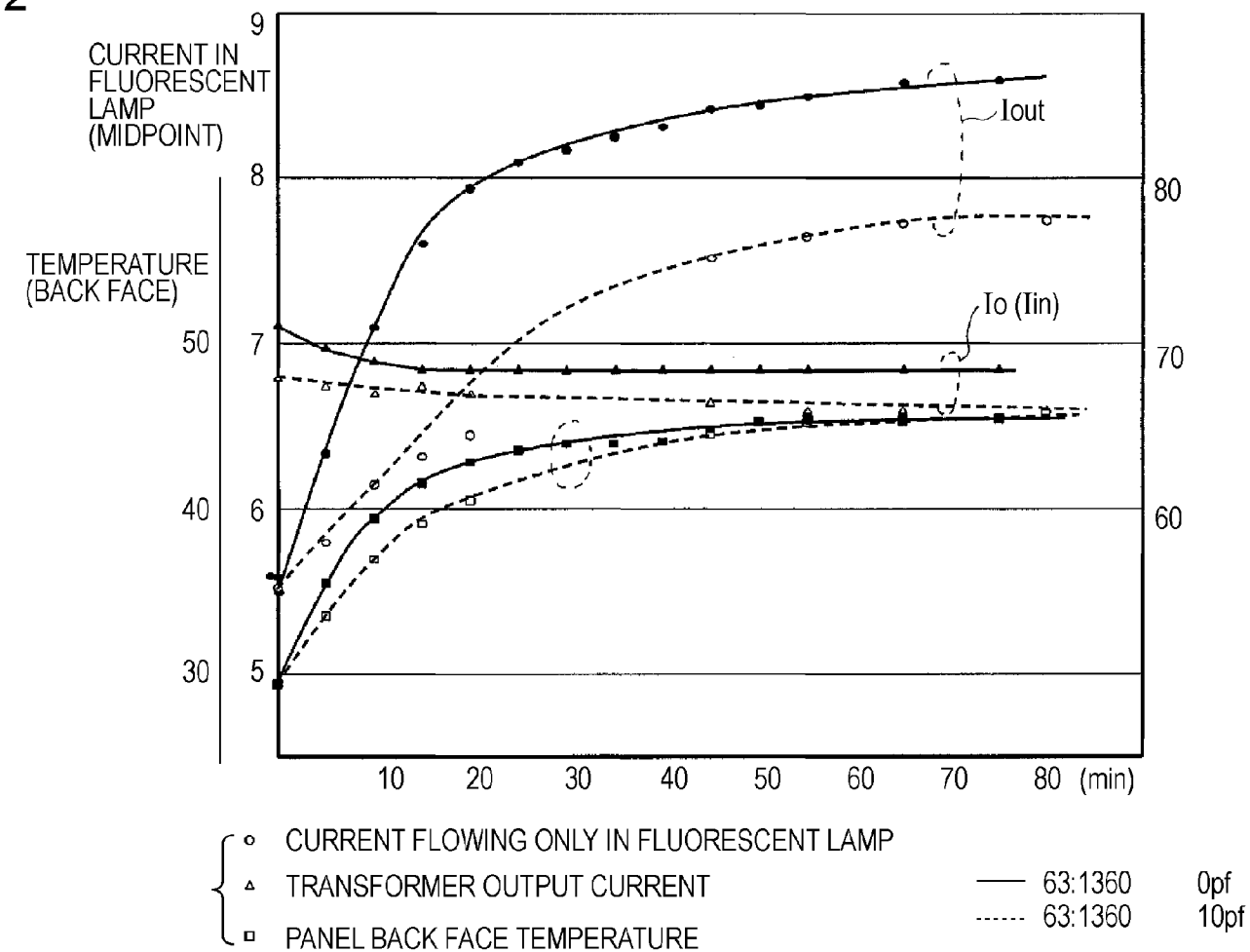
FIG. 2 is a characteristic chart showing relationships among a current flowing only in a fluorescent lamp in the first embodiment of the present invention, a sum current Io (current Iin) that is controlled to be constant, and a panel back face temperature (fluorescent lamp temperature)

FIG. 2 is a characteristic chart showing relationships among the current Iout flowing only in the fluorescent lamps 3, the sum current Io (the current Iin) that is controlled to be constant, and a panel back face temperature (the temperature of the fluorescent lamps 3).

In other words, even if the magnitude of the current Iin output from the inverter circuit 1 is controlled to be constant, the impedance of the fluorescent lamps 3 changes due to ambient temperature and self-heating. Thus, the current Iout flowing only in the fluorescent lamps 3 is influenced. Even if the magnitude |Iin| of the current Iin output from the inverter circuit is controlled to be constant, the phase angle of the impedance of the fluorescent lamps 3 also changes. Thus, in the example of FIG. 7, the phase angle of the current Iin also changes from $\phi$1 to $\phi$2, and the current Iin changes to Iin**.

A change including a phase 0 of the sum current Io supplied to the fluorescent lamps 3, that is, a change in impedance of the fluorescent lamps 3, is approximated by a proportionality relation with an operating temperature change of the fluorescent lamps 3, the relation having a coefficient. Accordingly, the change (shown in FIG. 7) from $\phi$1 to $\phi$2 of the phase 0 of the sum current Io (the current Iin) supplied to the fluorescent lamps 3 can be approximately detected by detecting a change in the temperature of the fluorescent lamps 3.

Therefore, by detecting a change in operating temperature of the fluorescent lamps 3, correcting, on the basis of the change in operating temperature of the fluorescent lamps 3, the amount of control in the case of controlling the magnitude of the sum current Io (the current Iin) supplied to the fluorescent lamps 3 to be constant, and, in the example of FIG. 7, performing control for correction not to Iin** but to Iin*, in accordance with a change of the phase $\phi$ from $\phi$1 to $\phi$2 of the sum current Io (the current Iin) output from the inverter circuit 1 and supplied to the fluorescent lamps 3, the current Iout flowing only in the fluorescent lamps 3 is corrected from Iout** to the current Iout* that flows only in the fluorescent lamps 3 in the case of the sum current Io (the current Iin) in the phase $\phi$1, so that the Iout flowing only in the fluorescent lamps 3 is controlled to be typically constant as the current Iout*.

In other words, since the impedance of the fluorescent lamps 3 changes due to ambient temperature or self-heating, by correcting, in accordance with the temperature change (change in impedance of the fluorescent lamps 3) of the fluorescent lamps 3, the amount of control in the case of maintaining the sum current Io (the current Iin) supplied from the inverter circuit 1 to the fluorescent lamps 3 to be constant, as shown in FIG. 7, the magnitude of the sum current Io, that is, the magnitude of the current Iin, is adjusted from Iin** to Iin*.

As a result, the current Iout flowing only in the fluorescent lamps 3 is maintained to be typically a constant current value of Iout*. This indicates that, even if the impedance of the fluorescent lamps 3 changes due to the ambient temperature or self-heating, the current Iout flowing only in the fluorescent lamps 3 is adjusted to be constant and the luminance of the fluorescent lamps 3 does not change.

In the first embodiment, an effective current (Iout) which changes with the operating temperature and which flows only in the fluorescent lamps 3 is corrected so as to be substantially constant.

To obtain the operating temperature of the fluorescent lamps 3, here, a negative temperature coefficient thermistor in which a resistance decreases as the temperature increases is used as the temperature detecting element Rt. The temperature detecting element Rt is provided in proximity to the fluorescent lamps 3, or is attached to the fluorescent lamps 3.

The temperature detecting element Rt and the resistor R1 are connected in series to the direct current power supply line Vcc. The voltage E1 at the junction point between the temperature detecting element Rt and the resistor R1 increases as the temperature increases. Accordingly, the voltage E1 is used as a voltage for correction.

Control of the sum current Io of the inverter circuit 1 to be constant is realized such that the amount of a voltage drop generated by the sum current Io flowing in the shunt resistor Rs is rectified by the diode D1 and fed back to the PWM control unit 4 so that the amount of the voltage drop in the shunt resistor Rs is constant.

By inserting resistors R5, R3, and R2 in this circuit, the voltage E1 (at the junction point between the temperature detecting element Rt and the resistor R1) that increases as the temperature of the fluorescent lamps 3 increases is applied to the feedback system through the resistor R3 and the diode D2, whereby the amount of the voltage drop generated in the shunt resistor Rs is biased. Thus, correction is performed so that, when the temperature of the fluorescent lamps 3 increases, an input voltage E2 of the PWM control unit 4 is increased. In addition, control for correction is performed so that the sum current Io decreases.

In this case, by appropriately selecting the resistances of the resistors R2, R3, and R5, the amount of correction of the sum current Io on the basis of the temperature can be changed.

The circuit configuration shown in FIG. 1 is an example. Here, the sum current Io is corrected. However, the control can be realized also by correcting a reference voltage. Also, a negative temperature coefficient thermistor is used as the temperature detecting element Rt. However, if there is an element in which quantity changing with the temperature has a predetermined characteristic, by providing the element with a circuit for amplifying the quantity, the element can be used.

A positive temperature coefficient thermistor, a forward voltage (Vf) of a diode, a base-emitter conduction voltage of a transistor, etc., can be used. Instead of directly detecting the temperature of the fluorescent lamps 3, even by detecting heat of a housing for a backlight unit including the fluorescent lamps 3, a value that approximates the operating temperature of the fluorescent lamps 3 can be obtained.

As described above, according to the first embodiment, by performing correction in accordance with the operating temperature of the fluorescent lamps 3 in the case of controlling the sum current Io to be constant, the current Iout flowing only in the fluorescent lamps 3 can be controlled. Thus, even if the operating temperature of the fluorescent lamps 3 changes due to a change in ambient temperature, self-heating of the fluorescent lamps 3 in a continuous operation mode, or heat generated in the apparatus, the luminance of the backlight unit can be maintained to be constant.

In addition, by detecting the operating temperature of the fluorescent lamps 3 and performing control for correction, a stable operation can be ensured while suppressing a change in luminance of the fluorescent lamps 3 due to a difference in environment such as low temperature or high temperature, and heat generation after the apparatus operates.

The fluorescent lamps 3 have types such as CCFL, hot cathode fluorescent lamp (HCFL), and external electrode fluorescent lamp (EEFL).

Even a CCFL has many types such as differences in internal gas pressure and differences in lamp diameter and length. These differences cause impedance characteristic changes caused by an operating temperature change of the fluorescent lamps 3. Accordingly, effective correction is performed even for a fluorescent lamp having a large impedance change, thus producing an advantage in that a stable operation is ensured while suppressing a luminance change of the fluorescent lamps 3 on the basis of the operating temperature of the fluorescent lamps 3.

Second Embodiment

Next, a second embodiment of the present invention is described.

Figure 3:
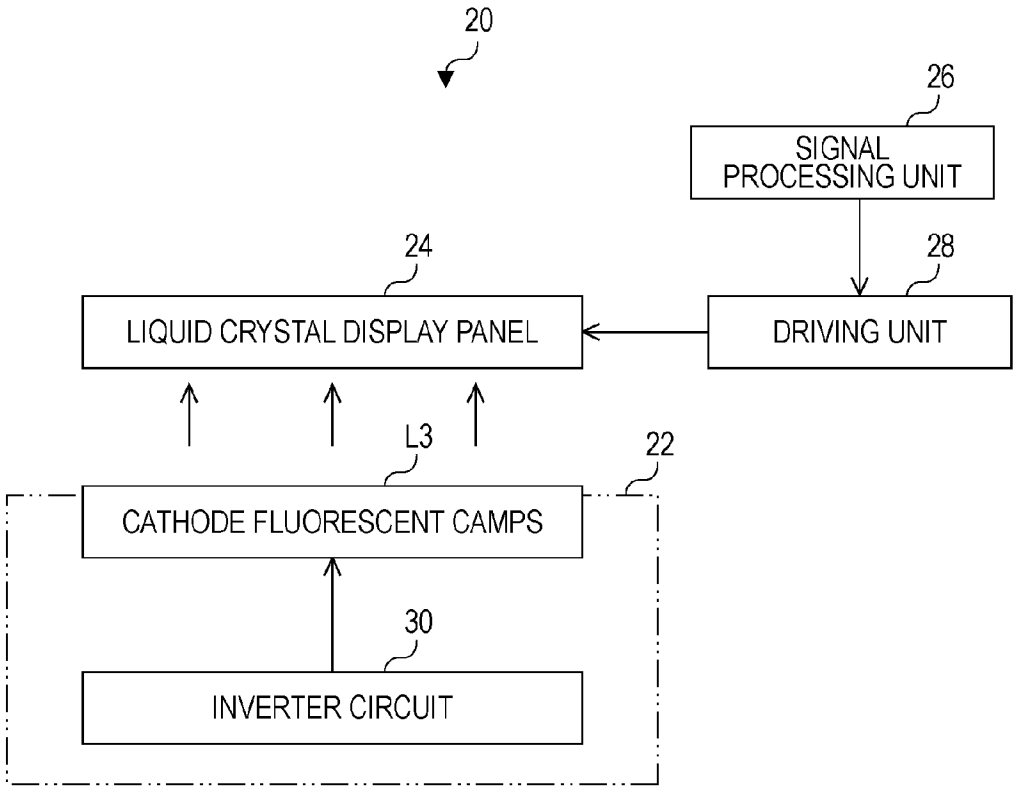
FIG. 3 is a block diagram showing the configuration of a display apparatus in a case in which the fluorescent lamp driving circuit in the first embodiment of the present invention is used for a backlight device.
Figure 4:
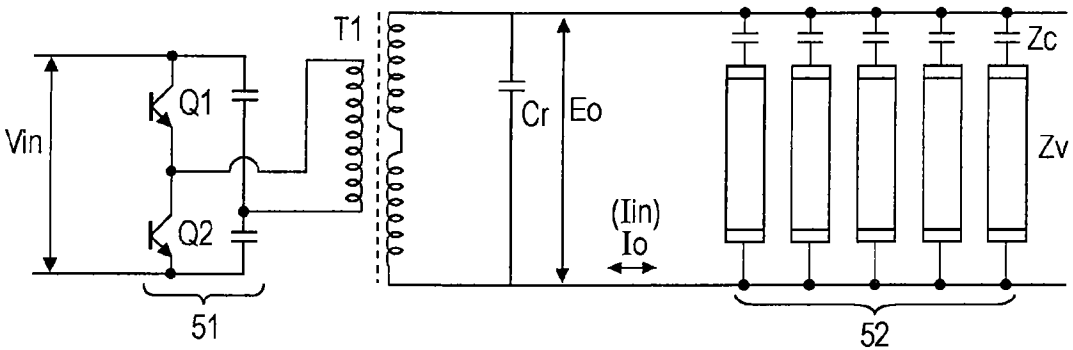
FIG. 4 is a circuit diagram showing a fluorescent lamp driving circuit of the related art.
Figure 5:
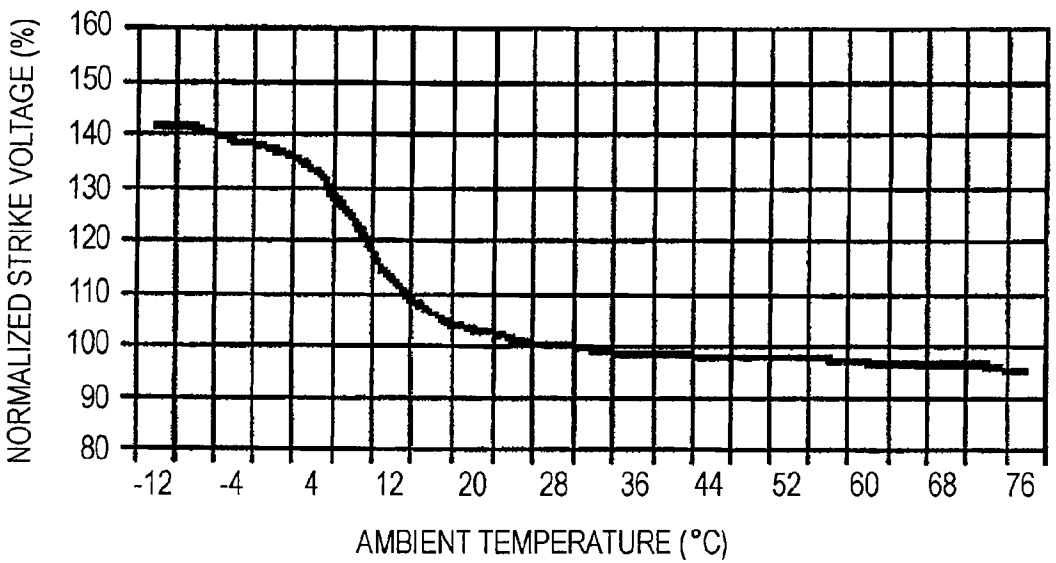
PRIOR ART FIG. 5
FIG. 5 is a characteristic chart showing a relationship between ambient temperature of the CCFLs of the related art and a terminal voltage across ends of the CCFLs.

FIG. 3 is a block diagram showing the configuration of a display apparatus 20 in a case in which the fluorescent lamp driving circuit in the first embodiment is used for a backlight device 22.

The display apparatus 20 includes the backlight device 22, a liquid crystal panel 24, a signal processing unit 26, and a driving unit 28.

The backlight unit 22 includes a plurality of cathode fluorescent lamps L3, and a fluorescent lamp driving circuit 30 as an inverter.

The cathode fluorescent lamps L3 are disposed facing a back face of the liquid crystal panel 24.

The fluorescent lamp driving circuit 30 has the configuration described in the first embodiment, and drives the cathode fluorescent lamps L3 to emit light.

The signal processing unit 26 performs signal processing on an image signal supplied from an image signal generating unit provided outside or inside the display apparatus 20, and supplies the processed signal to the driving unit 28.

The driving unit 28 generates a driving signal for driving the liquid crystal display panel 24 on the basis of the image signal supplied from the signal processing unit 26, and supplies the driving signal to the liquid crystal display panel 24.

The liquid crystal display panel 24 includes two transparent glass substrates, a liquid crystal layer provided between the glass substrates, transparent electrodes provided on internal surfaces of the glass substrates, a color filter, and a polarizer.

The driving signal is supplied to the liquid crystal display panel 24 and the liquid crystal in the liquid crystal display layer is driven in a state in which light from the cathode fluorescent lamps L3 is emitted to the liquid crystal display panel 24 from its back face, whereby an image is displayed.

According to the display apparatus 20, an advantage is obtained in that, by using the backlight unit 22, the cathode fluorescent lamps L3 can emit light at uniform brightness.

It should be understood by those skilled in the art that various modifications, combinations, sub-combinations and alterations may occur depending on design requirements and other factors insofar as they are within the scope of the appended claims or the equivalents thereof.

What is claimed is:

1. A fluorescent lamp driving method for driving a fluorescent lamp by using an alternating current driving signal generated by an inverter circuit using direct current power as an input, the alternating current driving signal being supplied from the inverter circuit to a load including the fluorescent lamp, the fluorescent lamp driving method comprising the steps of:

by using a sum current detecting circuit, detecting a current change in the supplied alternating current driving signal;

by using a control circuit, controlling the alternating current driving signal generated by the inverter circuit on the basis of the current change detected by the sum current detecting circuit, and controlling a current of the supplied alternating current driving signal to be constant;

by using a temperature detecting circuit, detecting the temperature of the fluorescent lamp; and by using a correction circuit, on the basis of the temperature of the fluorescent lamp detected by the temperature detecting circuit, correcting the control of the current of the supplied alternating current driving signal to be constant.

2. The fluorescent lamp driving method according to claim 1, wherein, in the step of detecting the temperature of the fluorescent lamp, the temperature detecting circuit directly detects the temperature of the fluorescent lamp.

3. The fluorescent lamp driving method according to claim 1, wherein, in the step of detecting the temperature of the fluorescent lamp, the temperature detecting circuit indirectly detects the temperature of a housing for a backlight unit including the fluorescent lamp.

4. A fluorescent lamp driving circuit for driving a fluorescent lamp by using an alternating current driving signal generated by an inverter circuit using direct current power as an input, the alternating current driving signal being supplied from the inverter circuit to a load including the fluorescent lamp, the fluorescent lamp driving circuit comprising:

a sum current detecting circuit configured to detect a current change in the supplied alternating current driving signal;

a control circuit configured to control the alternating current driving signal generated by the inverter circuit on the basis of the current change detected by the sum current detecting circuit, and configured to control a current of the supplied alternating current driving signal to be constant;

a temperature detecting circuit configured to detect the temperature of the fluorescent lamp; and a correction circuit configured to correct, on the basis of the temperature of the fluorescent lamp detected by the temperature detecting circuit, the control of the current of the supplied alternating current driving signal to be constant.

5. The fluorescent lamp driving circuit according to claim 4, wherein the temperature detecting circuit directly detects the temperature of the fluorescent lamp.

6. The fluorescent lamp driving circuit according to claim 4, wherein the temperature detecting circuit indirectly detects the temperature of a housing for a backlight unit including the fluorescent lamp.

7. A display apparatus comprising:

a liquid crystal display panel configured to display an image; and a backlight device configured to illuminate the liquid crystal display panel, wherein the backlight device includes a fluorescent lamp driving circuit including a sum current detecting circuit configured to detect a current change in an alternating current driving signal generated by an inverter circuit using direct current power as an input, the alternating current driving signal being supplied to a load including a fluorescent lamp, a control circuit configured to control the alternating current driving signal generated by the inverter circuit on the basis of the current change detected by the sum current detecting circuit, and configured to control a current of the supplied alternating current driving signal to be constant, a temperature detecting circuit configured to detect the temperature of the fluorescent lamp, and a correction circuit configured to correct, on the basis of the temperature of the fluorescent lamp detected by the temperature detecting circuit, the control of the current of the supplied alternating current driving signal to be constant.

8. A backlight device for illuminating a liquid crystal display panel for displaying an image, comprising:

a sum current detecting circuit configured to detect a current change in an alternating current driving signal generated by an inverter circuit using direct current power as an input, the alternating current driving signal being supplied to a load including a fluorescent lamp;

a control circuit configured to control the alternating current driving signal generated by the inverter circuit on the basis of the current change detected by the sum current detecting circuit, and configured to control a current of the supplied alternating current driving signal to be constant;

a temperature detecting circuit configured to detect the temperature of the fluorescent lamp; and a correction circuit configured to correct, on the basis of the temperature of the fluorescent lamp detected by the temperature detecting circuit, the control of the current of the supplied alternating current driving signal to be constant.

* * * * *